United States Patent [19]

Carter, II et al.

[11] 4,384,971

[45] May 24, 1983

[54] CLEANSING COMPOSITION FOR ELECTRONIC PARTICLE COUNTING APPARATUS; AND METHOD FOR ITS USE

[75] Inventors: James H. Carter, II, Ft. Lauderdale; Harold R. Crews, Miami, both of Fla.

[73] Assignee: Coulte Electronics, Inc.

[21] Appl. No.: 295,933

[22] Filed: Aug. 24, 1981

[51] Int. Cl.[3] ..... C11D 3/48

[52] U.S. Cl. ..... 252/106; 252/174.21; 252/542

[58] Field of Search ..... 252/542, 106, 174.21

[56] References Cited

U.S. PATENT DOCUMENTS

| | | | |
|---|---|---|---|
| 2,665,256 | 1/1954 | Barker | 252/106 |
| 2,742,434 | 4/1956 | Kopp | 252/106 |
| 3,928,605 | 12/1975 | Curry | 252/106 |

*Primary Examiner*—Michael R. Lusignan
*Assistant Examiner*—Janyce A. Bell
*Attorney, Agent, or Firm*—Meredith P. Sparks; Gerald R. Hibnick

[57] ABSTRACT

An isotonic cleansing agent and method for its use in electronic instrumentation systems for determining hematological components of blood samples are described. The cleansing agent comprises an aqueous solution of a non-hemolytic polyoxyethylated alkylphenol detergent, dimethylolurea, and an isotonic and isoconductive saline base which is free of phosphates. The dimethylolurea serves as a cell stabilizer, and also acts as a germicidal agent, together with other added germicidal agents, particularly sodium 1-hydroxypyridine-2-thione.

8 Claims, No Drawings

CLEANSING COMPOSITION FOR ELECTRONIC PARTICLE COUNTING APPARATUS; AND METHOD FOR ITS USE

BACKGROUND OF THE INVENTION

This invention concerns an isotonic cleansing agent and method for use in electronic instrumentation systems for determining hematological components of blood samples. It is especially suitable for use in semi-automated and automated systems designed for electronic enumeration and sizing of blood cells, detection of hemoglobin and their collective indices, platelet parameters and lymphoid-myeloid populations of leukocytes in a single blood sample. The cleanser comprises a water solution of chemical salts, providing an electrolytic solution capable of conducting current, and a non-hemolytic detergent suitable for cleansing sensing apertures and associated fluid pathways within the instrument system.

Certain classical determinations are commonly made on patient blood samples to provide medical baseline or diagnostic information to the attending physician in order to assist in the proper diagnosis and treatment of disease. These include the red blood cell count (RBC), the hematocrit (HCT), the hemoglobin (HGB), the mean corpuscular volume (MCV), the mean corpuscular hemoglobin (MCH), the mean corpuscular hemoglobin concentration (MCHC), the platelet count (PLT), the mean platelet volume (MPV), the white blood cell count (WBC) and, more recently, the relative lymphoid and myeloid populations comprising the total white blood cell count.

Much effort has been devoted to the development of satisfactorily automated leukocyte differential systems, especially one that is easily adaptable to automatic blood counting instruments. In particular, it is desirable to develop reagents and methods for use with the Coulter Counter® Model S-Plus automated blood counter, manufactured by Coulter Electronics, Inc. of Hialeah, Fla., which will enable the cell volume data accumulated on a Coulter Channelyzer® particle size analyzer to discriminate two populations of leukocytes: (1) a lymphoid (lymphocyte series) population, and (2) a myeloid (granulocyte series) population. Such data are useful as a screening tool for spotting abnormal leukocyte ratios. Abnormal situations flagged out by this method give information of diagnostic significance, and for further study.

Satisfactory performance of any of the counting and sizing features of automated hematology using electronic pulse spectrometry is dependent on maintaining clean and unimpeded fluid pathways, especially in and near the sensing apertures. Due to the small size of the aperture and the inaccessability of much of the fluid path, it is necessary to use a fluid cleansing agent in order to reach every part of the fluid system to clean away deposits and prevent buildup of minerals and especially protein from the blood samples.

The cleansing agent must meet several criteria to be usable in an enclosed automated blood counting system. Primarily, the agent must be chemically fast and effective, but not so strong as to damage glass and plastic-ware upon extended contact. Secondarily, the agent should be: (a) isotonic so as to be isoconductive with the blood diluent being used; (b) it must be fully compatible with the diluent so as not to cause any chemical or physical decomposition creating interfering debris in or near the sensing apertures; (c) it should not be hemolytic or overly destructive towards blood cells, since traces of it may remain in the fluid pathways even after flushing with the blood diluent; (d) it should be visually distinguishable from the blood cell diluent by color, density or some other easily visible property.

SUMMARY OF THE INVENTION

The present invention relates to an isotonic, multi-purpose cleansing agent and method for its use in electronic instrumentation systems for determining hematological components of blood samples. It is compatible with blood diluents and lysing agents designed to enumerate all traditional hemogram values, as well as the lymphoid and myeloid populations comprising the total white blood cell count. It is especially suitable for use in semi-automated and automated systems utilizing the diluent described in United States Patent Application Ser. No. 159,782, filed June 16, 1980. The cleansing agent comprises an aqueous solution of a non-hemolytic polyoxyethylated alkylphenol detergent, dimethylolurea, and an isotonic and isoconductive saline base which is free of phosphates. The dimethylolurea serves as a cell stabilizer, and also acts as a germicidal agent, together with other added germicidal agents, particularly sodium 1-hydroxypyridine-2-thione.

DETAILED DESCRIPTION OF THE INVENTION

The multi-purpose isotonic cleansing agent of this invention comprises a non-hemolytic detergent and germicides in an osmotically balanced and substantially aqueous solution that is visually distinguishable from the diluent employed for the blood sample. More particularly, it includes:

1. A polyoxyethylated alkylphenol detergent
2. Sodium 1-hydroxypyridine-2-thione
3. Dimethylolurea
4. Sodium sulfate and sodium chloride
5. A green dye mixture
6. Lime oil the cleansing agent being adjusted to 320±10 milliosmoles per kilogram with sodium chloride.

The concentration of each material is designed to produce optimal benefit in cleansing action as well as electrical conductivity and rinsability.

The non-hemolytic detergents suitable for this purpose include polyoxyethylated alkylphenols which are manufactured by methods known in the art by reaction of alkylated phenols with an excess of ethylene oxide to form alkyl aryl ethers of polyethylene glycol by the following reaction:

$$RC_6H_4OH + xH(CH_2CH_2O) \rightarrow RC_6H_4O(CH_2CH_2O)xCH_2CH_2OH$$

where R is an alkyl group having 8 to 10 carbon atoms, and x is an integer 8 to 12.

An especially preferred polyoxyethylated alkylphenol for this invention is a product sold in the trade as DIAZOPON® SS-837. It has the following product characteristics:

| | |
|---|---|
| Appearance | clear, almost water-white liquid |
| 1% solution | clear and colorless |
| Solubility in water | readily soluble, even in cold water |
| pH of 1% solution | neutral |
| Stability | stable to acids, alkalis and metallic ions |

-continued

| | |
|---|---|
| Cloud Point | clear at 212° F. (100° C.) |

It is selected from its ability to remove salt and protein deposits at relatively low concentrations. In addition, unlike most detergents, it is non-hemolytic to blood cells at their low concentration.

DESCRIPTION OF THE PREFERRED EMBODIMENTS

The preferred formulation of the isotonic cleansing agent is:

| Ingredient | Preferred Concentration | Concentration Range |
|---|---|---|
| 1. DIAZOPON® SS-837 | 14.0 ml/L | 10–20 ml/L |
| 2. Green dye mixture | 0.53 ml/L | 0.2–1.0 ml/L |
| 3. Sodium 1-hydroxypyridine-2-thione (as 40% solution) | 0.25 ml/L | 0.2–0.6 ml/L |
| 4. Dimethylolurea | 1.0 g/L | 0.5–2.0 g/L |
| 5. Sodium sulfate | 9.72 g/L | 9.0–10.0 g/L |
| 6. Sodium chloride | 4.5 g/L | 3.9–5.0 g/L |
| 7. Lime Oil | 0.078 ml/L | 0.06–0.1 ml/L |
| 8. Water | Sufficient for 1 liter | |

The cleansing agent is adjusted to 320±10 milliosmoles per kilogram with sodium chloride as necessary. If it is necessary to change the sodium sulfate:sodium chloride ratio, conductivity should also be readjusted to $1.7-1.9\times10^4$ micro-mhos per centimeter in order to remain isoconductive with the blood diluent system.

Dimethylolurea serves as a cell stabilizer and is necessary to provide cell stabilization in the event that traces of cleansing agent remain in the fluid pathway of an automated counting instrument, thus mixing with a blood sample and the blood diluent. In this way, such a sample will behave normally and will not produce spurious hemogram values.

Dimethylolurea also serves as a germicidal agent. Although dimethylolurea is reasonably effective in this capacity, it is advantageous to add other germicidal agents, such as 1-hydroxypyridine-2-thione or 2-phenoxyethanol or Bronidox L (5-bromo-5-nitro-1, 3-dioxane). The use of both dimethylolurea and sodium 1-hydroxypyridine-2-thione gives a very bacteriocidal product which is superior to that obtainable with either substance used alone, and exhibits no apparent deleterious effect on the shape, size distribution or number of the cellular components in whole human blood, if present in residual amounts after cleaning the electronic equipment.

The sodium sulfate and sodium chloride form the isotonic and isoconductive saline base which is necessary to provide a continuous electrical pathway and to assure osmotic stability of the blood cells in suspension. The saline base is free of phosphates, which further inhibits the growth of contaminating organisms that require phosphate for growth, and also affect the red cell stability inasmuch as phosphates are utilized in cell metabolism. The salts are specifically balanced to provide osmotic and conductive parameters equal to that of the blood diluent disclosed in copending U.S. Patent Application Ser. No. 159,782, filed June 16, 1980 now U.S. Pat. No. 4,346,018, issued Aug. 24, 1982.

The green dye mixture is formulated to a color standard from blue, green and yellow (egg shade) dyes for consistency. It serves solely as a visual indicator for the reagent.

Lime oil is added merely as a scent to mask the slightly unpleasant odor of the detergent ingredient.

We claim:

1. An isotonic cleansing agent for use in electronic instrumentation systems for determining hematological components of blood samples, comprising an aqueous solution of:

a. A nonionic polyoxyethylated alkylphenol b. Dimethylolurea c. Sodium sulfate and sodium chloride, said cleansing agent being adjusted to 320±10 milliosmoles per kilogram with sodium chloride.

2. The isotonic cleansing agent of claim 1 including sodium 1-hydroxypyridine-2-thione.

3. The isotonic cleansing agent of claim 1 including 2-phenoxyethanol.

4. The isotonic cleansing agent of claim 1 wherein said nonionic polyoxyethylated alkylphenol has the following product specifications:

| | |
|---|---|
| Appearance | Clear, almost water-white liquid |
| 1% solution | Clear and colorless |
| Solubility in Water | Readily soluble, even in cold water |
| pH of 1% Solution | Neutral |
| Stability | Stable to acids, alkalis and metallic ions |
| Cloud Point | Clear at 212° F. (100° C.). |

5. The isotonic cleansing agent of claim 1 wherein said dimethylolurea is present in a concentration from 0.5–2.0 g/L.

6. A method for cleansing electronic instrumentation systems for determining hematological components of blood samples, comprising the use of an aqueous solution of:

a. A nonionic polyoxyethylated alkylphenol b. Dimethylolurea c. Sodium sulfate and sodium chloride, said cleansing agent being adjusted to 320±10 milliosmoles per kilogram with sodium chloride.

7. The method of claim 6 including sodium 1-hydroxypyridine-2-thione as an antibacterial agent.

8. The isotonic cleansing agent or method of claim 1 or 6 in which said sodium sulfate and sodium chloride are present in a concentration sufficient to form an isotonic and isoconductive saline base which is phosphate free.

* * * * *